US005095816A

United States Patent [19]

Hasegawa et al.

[11] Patent Number: 5,095,816

[45] Date of Patent: Mar. 17, 1992

[54] MIMEOGRAPHIC PRINTING MACHINE

[75] Inventors: Takanori Hasegawa, Hachioji; Akira Yasuda, Kawagoe; Takanobu Shimada, Machida, all of Japan

[73] Assignee: Riso Kagaku, Tokyo, Japan

[21] Appl. No.: 654,105

[22] Filed: Feb. 11, 1991

[30] Foreign Application Priority Data

Feb. 20, 1990 [JP] Japan ..... 2-37178

[51] Int. Cl.[5] ..... B41F 15/42

[52] U.S. Cl. ..... 101/119; 101/120

[58] Field of Search ..... 101/116, 119, 120; 118/406

[56] References Cited

U.S. PATENT DOCUMENTS

| | | | |
|---|---|---|---|
| 1,538,399 | 5/1925 | Green | 101/120 |
| 3,796,153 | 3/1974 | Jaffa | 101/119 |
| 3,834,307 | 9/1974 | Zimmer | 101/119 |
| 3,988,986 | 11/1976 | Zimmer | 101/119 |
| 4,036,129 | 7/1977 | Zimmer | 101/120 |
| 4,232,601 | 11/1980 | Mitter | 101/120 |

FOREIGN PATENT DOCUMENTS

| | | |
|---|---|---|
| 58-62520 | 4/1983 | Japan . |
| 60-4062 | 1/1985 | Japan . |

*Primary Examiner*—Edgar S. Burr
*Assistant Examiner*—Stephen R. Funk
*Attorney, Agent, or Firm*—Kanesaka and Takeuchi

[57] ABSTRACT

A mimeographic printing machine general comprises: a rotary plate cylinder for supporting a stencil on an outer circumferential surface thereof and having a perforation for passage of ink, the plate cylinder being rotatable with the stencil; means for supplying the ink to an inner circumferential surface of the plate cylinder; a squeegee movably received in the plate cylinder so as to come into and out of contact with the inner circumferential surface of the plate cylinder, the squeegee being operable to squeeze the ink from the supplying means toward the outer circumferential surface of the plate cylinder through the perforation of the plate cylinder; and a rod-shaped member rotatably received in the plate cylinder. The rod-shaped member is located behind the squeegee in the rotating direction of the plate cylinder and is movable with the squeegee for jointly holding the ink.

9 Claims, 15 Drawing Sheets

MIMEOGRAPHIC PRINTING MACHINE

BACKGROUND OF THE INVENTION

1. Field of the Invention

This invention relates to a mimeographic printing machine in which a rotary plate cylinder supports on its outer circumferential surface a stencil and transfers an original image to a paper sheet with ink supplied from inside the plate cylinder through pores of the stencil.

2. Description of the Related Art

A mimeographic printing machine is known in which a rotary plate cylinder supports on its outer circumferential surface a stencil and transfers an original image to a paper sheet with ink supplied from inside the plate cylinder through pores of the stencil.

In such a printing machine, as shown in FIG. 14 of the accompanying drawings, an ink supply mechanism located in the plate cylinder includes a squeegee roller 101 and a doctor roller 102 in contact with the squeegee roller 101.

With this ink supply mechanism, it is very difficult to adjust a clearance between the squeegee roller 101 and the inner circumferential surface of the plate cylinder. Therefore it would be further difficult to regulate the amount of ink to be supplied. The inner circumferential surface of the plate cylinder 100 and the outer circumferential surface of the squeegee roller 101 are in contact with each other tangentially to squeeze the ink more than necessary. The excessive ink gathers at a perforation-free portion, i.e. a trailing end, of the stencil. Then the gathered ink overflows from the trailing end of the stencil to smear the paper sheet.

It is conceivable to increase the viscosity of the ink so as to overcome the inconvenience encountered with the prior art. Having an increased viscosity, however, the ink hardly permeates into the tissues of the paper sheet, which would result in an insufficient printing density.

In an attempt to overcome these prior problems, a mimeographic printing machine has been developed, in which the squeegee is located inside the plate cylinder. In use, the squeegee is brought into contact with the plate cylinder and is rotated with the plate cylinder. Ink is supplied to the inner circumferential surface of the plate cylinder and is then squeezed toward the stencil wound on the outer circumferential surface of the plate cylinder.

In the second-named printing machine, the squeegee is in direct contact with the inner circumferential surface of the plate cylinder. Therefore it is unnecessary to adjust a small clearance between the squeegee and the inner circumferential surface of the plate cylinder. Even if low-viscosity ink is used, it is possible to control the amount of ink to be supplied to the outer circumferential surface of the plate cylinder, because the squeegee is substantially in linear contact with the inner circumferential surface of the plate cylinder. Also the overflow of ink can be minimized effectively.

It is however still impossible to perfectly prevent the overflow of ink. The overflow of ink may be further minimized in the manner shown in FIG. 15. As shown in FIG. 15, a squeegee 103 does not serve to squeeze the ink to a perforation-free portion 104 of the stencil beyond the perforation of the stencil. Specifically, the squeegee 103 is moved upwardly once in front of the perforation-free portion 104, as indicated by an arrow in FIG. 15. For the next printing, the squeegee 103 is brought into contact with the inner circumferential surface of the plate cylinder at the perforation-free portion 104 in front of the perforation.

The overflow of ink can be prevented by the arrangement of FIG. 15, leaving the following difficulties unsettled.

Firstly, ink is supplied to an ink reservoir 105 defined between the inner circumferential surface of the plate cylinder 100 and the squeegee 103. As the plate cylinder 100 rotates, the squeegee 103 forces the ink against the inner circumferential surface of the plate cylinder 100 to push the ink toward the outer circumferential surface of the plate cylinder 100.

On the contrary, as shown in FIG. 16(*a*), when the squeegee 103 descends from the lifted position and starts contacting with the plate cylinder 100, there is no ink reservoir to be formed between the squeegee 103 and the inner circumferential surface of the cylinder 100. Specifically, the squeegee 103 starts contacting the inner circumferential surface of the plate cylinder at the trailing or upstream end of the perforation-free portion 104 of the plate cylinder 100. A small ink reservoir 105 may be formed while the squeegee 104 squeezes the ink toward the perforation 106 of the plate cylinder 100 as shown in FIG. 16(*b*).

However, since the squeegee 103 squeezes all of the ink from the ink reservoir 105 at the leading edge of the perforation 106 as shown in FIG. 16(*c*), it takes a certain period of time to form the ink reservoir 105 again for the next squeezing operation as shown in FIG. 16(*d*). Therefore the most freshly printed image has a normal density at its leading edge, a lower density at the central portion, and a normal density at the trailing end. In other words, the printed image would suffer non-uniform density.

SUMMARY OF THE INVENTION

It is therefore an object of this invention to provide a mimeographic printing machine which can overcome the problems of conventional printing machines.

According to a first aspect of this invention, there is provided a mimeographic printing machine comprising: a rotary plate cylinder for supporting a stencil on an outer circumferential surface thereof and having a perforation for passage of ink, the plate cylinder being rotatable with the stencil supported thereon; means for supplying the ink to an inner circumferential surface of the plate cylinder; a squeegee movably received in the plate cylinder so as to come into and out of contact with the inner circumferential surface of the plate cylinder, the squeegee being adapted to squeeze the ink from the supplying means toward the outer circumferential surface of the plate cylinder through the perforation of the plate cylinder; and a rod-shaped member rotatably received in the plate cylinder,; whereby the rod-shaped member is located in front of the squeegee in the rotating direction of the plate cylinder and is movable with the squeegee for jointly holding the ink.

Since the rod-shaped member is located in front of the squeegee in the rotating direction of the plate cylinder, the rod-shaped member is rotated by whirling ink in the ink reservoir during squeezing, so that the ink sticks around the rod-shaped member and uniformly spreads longitudinally along the squeegee.

Further, both the squeegee and the rod-shaped member are brought out of contact with the inner circumferential surface of the plate cylinder while keeping the positional relationship therebetween. Therefore the ink reservoir can always maintain the predetermined amount of ink.

According to a second aspect of the invention, both the squeegee and the rod-shaped member can be moved by a cam movable in response to the rotation of the plate cylinder, and a member for bringing the squeegee into contact with the inner circumferential surface of the plate cylinder at a predetermined timing in response to the movement of the cam.

According to a third aspect of the invention, both the squeegee and the rod-shaped member are normally urged away from the inner circumferential surface of the plate cylinder by a resilient member. The squeegee and the rod-shaped member are also moved by a cam movable in response to the rotation of the plate cylinder, and means for moving the squeegee and the rod-shaped member in response to angular movement of the cam and also for bringing the squeegee into contact with the inner circumferential surface of the plate cylinder at a predetermined timing.

According to a fourth aspect of the invention, the printing machine further comprises an arm supporting thereon the squeegee and the rod-shaped member and pivotally movable within the plate cylinder, a cam movable in response to the rotation of the plate cylinder, and a cam follower supported on the arm and resting on the cam. The squeegee is brought into contact with the inner circumferential surface of the plate cylinder by pivotal movement of the arm at a predetermined timing in response to the rotation of both the plate cylinder and the cam.

According to a fifth aspect of the invention, the supplying means includes a distributor for uniformly distributing the ink axially of the plate cylinder.

According to a sixth aspect of the invention, drive means is included for angularly moving the rod-shaped member in such a manner that the ink held by both the squeegee and the rod-shaped member is distributed longitudinally along the squeegee.

BRIEF DESCRIPTION OF THE DRAWINGS

FIG. 2(*b*) is a view similar to FIG. 2(*a*), showing the squeegee unit spaced from the plate cylinder;

FIG. 3(*b*) is a view similar to FIG. 3 (*a*), showing the squeegee unit spaced from the plate cylinder;

FIG. 7(*b*) is a view similar to FIG. 3(*a*), showing the squeegee unit contacting the plate cylinder;

DETAILED DESCRIPTION

A mimeographic printing machine according to a first embodiment will be described with reference to FIGS. 1 to 6.

Figure 1:
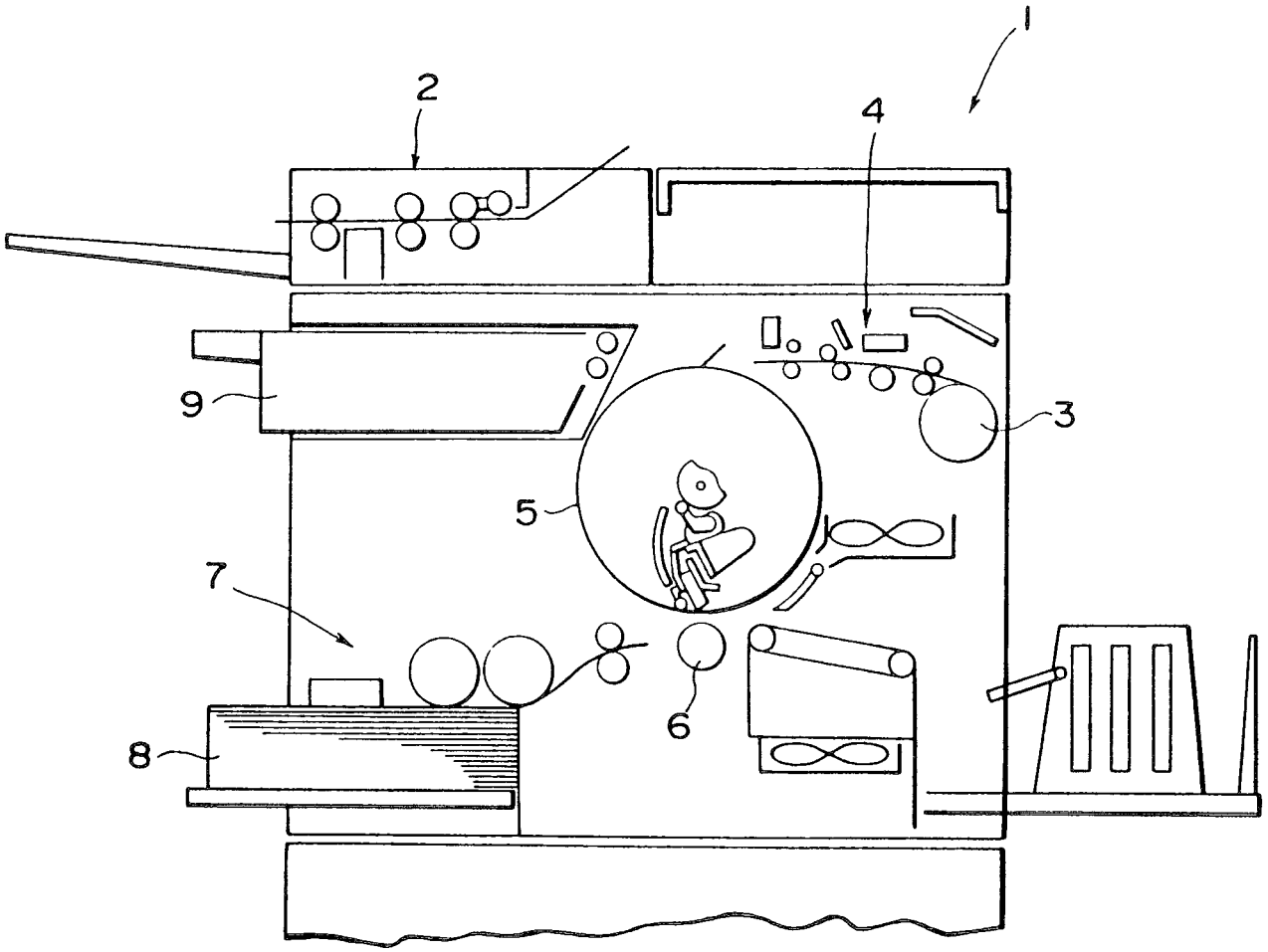
FIG. 1 is a schematic side view, with parts broken away, of the overall construction of a mimeographic printing machine according to a first embodiment of the invention.

As shown in FIG 1, the mimeographic printing machine 1 comprises an image reader 2, a stencil preparing unit 4 for preparing a perforated original image in a stencil roll according to data from the image reader 2, and a rotary plate cylinder 5 for supporting the stencil on the outer circumferential surface thereof. The plate cylinder is rotatable with the stencil supported thereon, and is located adjacent to the stencil preparing unit 4. Units such as an ink supply and a squeegee are located in the plate cylinder. The squeegee is brought into and out of contact with the inner circumferential surface of the plate cylinder in a manner described below. A press roller 6 and a printing paper supply 7 are with paper 8 are located under the plate cylinder 5. Mimeographic printing is successively carried out by the upward and downward movements of the press roller 6 in response to the rotation of the plate cylinder 5 as well as by the upward and downward movement of the squeegee. In FIG. 1, reference numeral 9 designates a receptor for receiving used stencils 3 one at a time as removed from the plate cylinder 5.

Figure 3A:
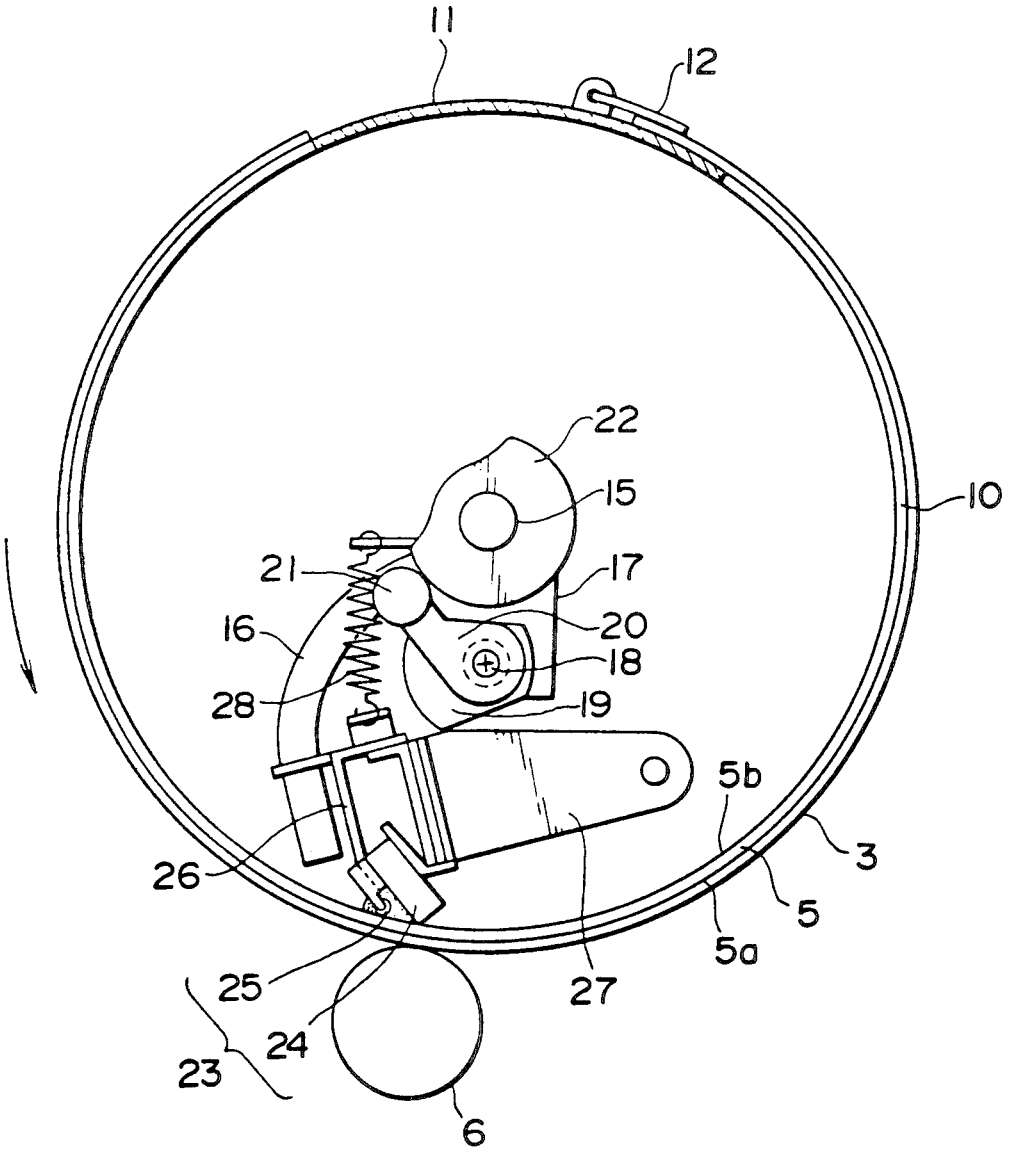
FIG. 3(*a*) is a transverse cross-sectional view of the plate cylinder, showing the squeegee unit contacting the plate cylinder.
Figure 3B:
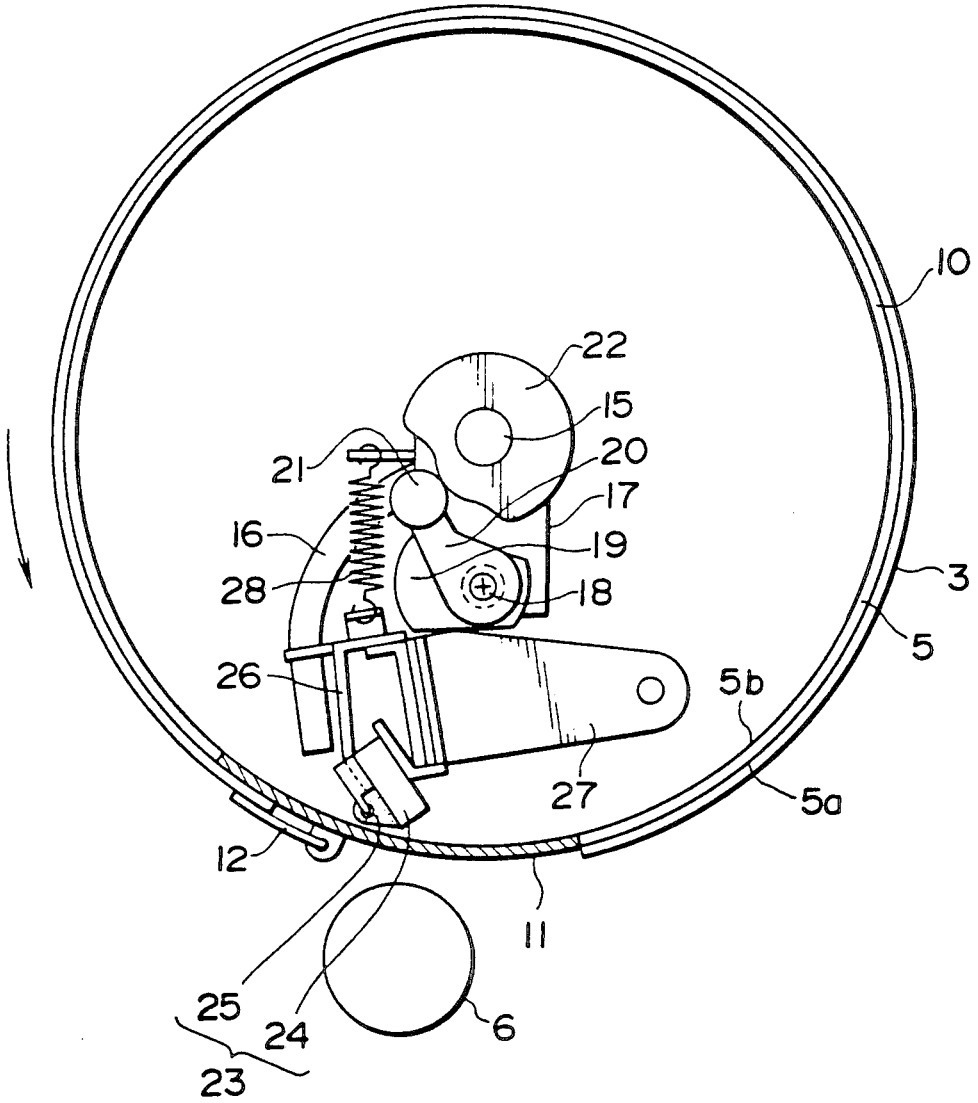
Figure 4A:
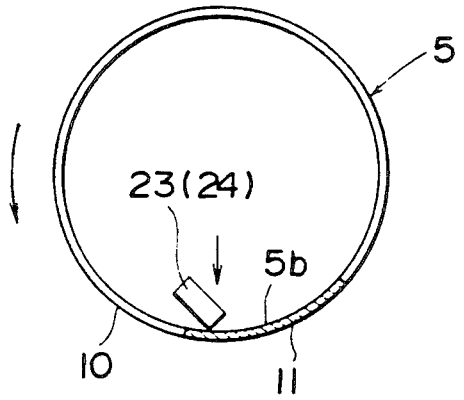
FIGS. 4(*a*) to 4(*d*) are views showing upward and downward movements of the squeegee unit.
Figure 4B:
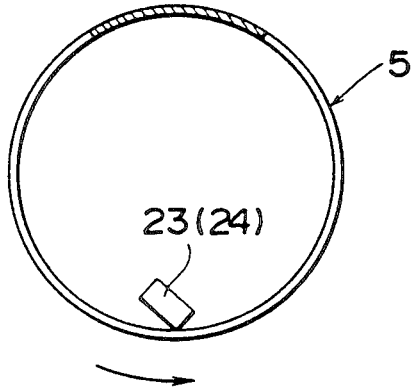
Figure 4C:
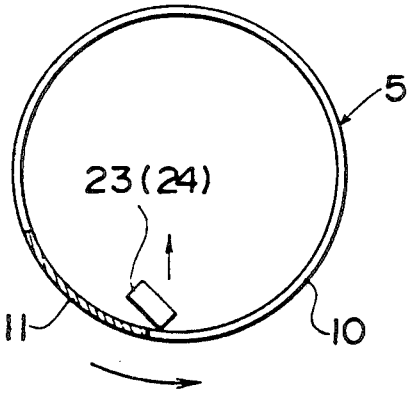
Figure 4D:
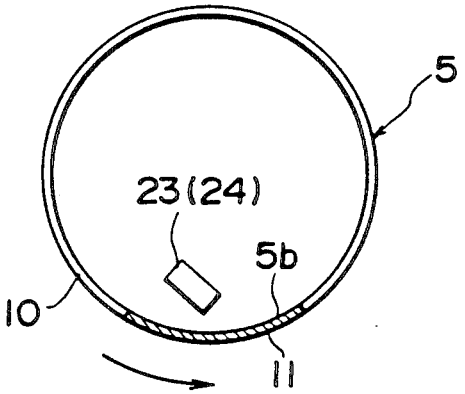

As illustrated in FIGS. 3, the plate cylinder supports the stencil 3 on the outer circumferential surface 5*a* thereof, including a perforation 10 for passage of ink to an image area on the stencil 3, and a perforation-free portion 11 on which a clamp 12 is located for gripping the leading edge of the stencil 3. The plate cylinder 5 is rotated on its own axis by a non-illustrated driving means.

Figure 2A:
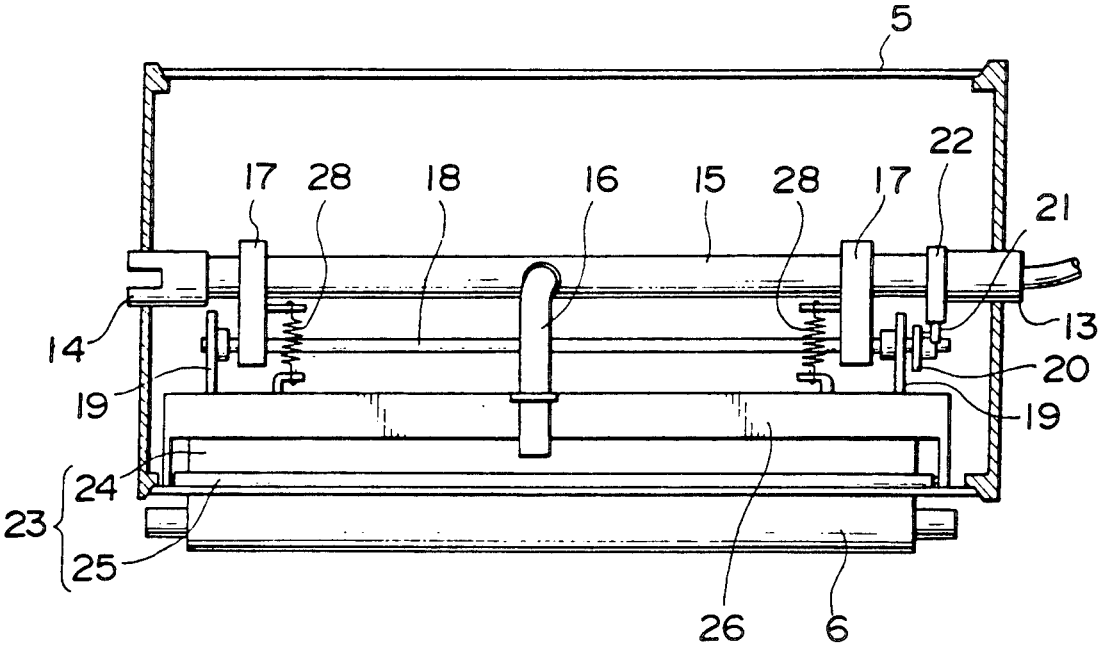
FIG. 2(*a*) is a longitudinal cross-sectional view of a plate cylinder in the printing machine of FIG. 1, showing a squeegee unit contacting the plate cylinder.
Figure 2B:
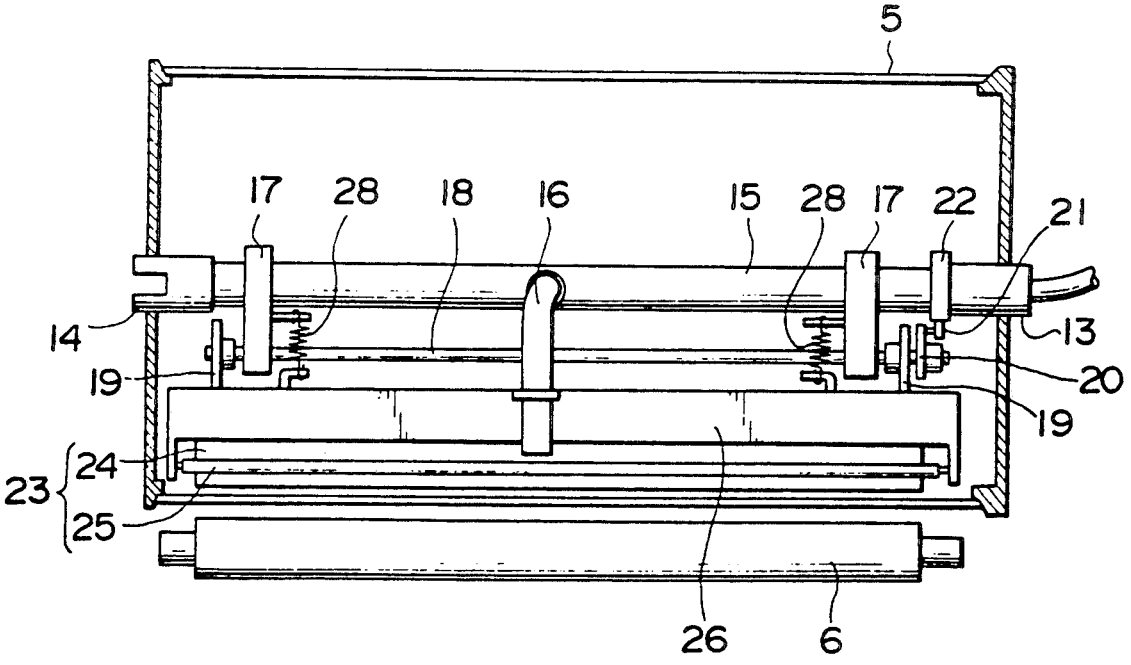

The plate cylinder 5 is supported at opposite ends by a pair of axially aligned support shafts 13, 14 which are rotatable together with the plate cylinder 5, as shown in FIGS. 2 and 3. The support shafts 13, 14 are supported by a non-illustrated support means located outside the plate cylinder 5. A tubular ink passage 15 extends through the support shafts 13, 14. The ink passage 15 is fixed so as not to move regardless of the rotation of the plate cylinder 5. One end of the ink passage 15 extends outwardly from the plate cylinder 5 so that the ink can be resupplied from an external source. A supply hose 16 is connected at one end to the central portion of the ink passage 15, with the other end located in the vicinity, of the central portion of the squeegee unit 23 in front of the rotating direction of the plate cylinder 5.

A pair of immovable plates 17, 17 is located on the ink passage 15, between which a shaft 18 is rotatably mounted. The shaft 18 has a pair of sector members 19, 19, each fixedly mounted on each end of the shaft 18.

Fixedly mounted on one end of t he shaft 1B is a support arm 20, on one end of which a cam follower 21 is rotatably supported. A cam 22 is fixed to an inner end of the support shaft 13, which is rotatable with the plate cylinder 5. The cam 22 is always in engagement with the cam follower 21. When the plate cylinder 5 rotates for printing, the support arm 20 is pivotally moved at a predetermined timing so as to follow the configuration of the cam 22. In response to the pivotal movement of the support arm 20, the shaft 18 is rotated in such a manner that the sector members 19 are pivotally moved to the extent shown in FIGS. 2(*a*) and 2(*b*), or FIGS. 3(*a*) and 3(*b*).

As shown in FIGS. 2 and 3, the squeegee unit 23 is movably received in the plate cylinder 5. The squeegee unit 23 ascends and descends in response to the pivotal movement of the sector members 19 at the predetermined timing. The squeegee unit 23 has a squeegee 24 and a rod-shaped member 25. In FIGS. 2 and 3, reference numeral 26 designates a squeegee support. Squeegee unit support arms 27 extend in opposite directions from the opposite ends of the squeegee support 26. The ends of the squeegee unit support arms 27 are pivotally supported on the plate cylinder 5 at a non-illustrated immovable portion (not shown) thereof. A pair of resilient members 28, 28 such as springs are located between one end of the squeegee support 26 and one end of the immovable plates 17. These resilient members 28, 28 are normally urging the squeegee support 26 upwardly to bring the squeegee support 26 into contact with the sector members 19.

The squeegee 24 is mounted on the squeegee support 26 as shown in FIGS. 2 and 3. In this embodiment, the squeegee 24 is made of urethane, having a hardness of 60° and being square in cross-sectional shape so as to obtain a suitable ink density. The term "hardness" here in this specification represents a value for the hardness which is obtained by measuring a specimen using a spring tester specified in Japanese Industrial Standard (JIS) K 6301. The spring tester indicates a distance in terms of hardness (degree) when a push pin extending from a pressure applying surface of the tester is brought into contact with the specimen and the push pin is pushed backwardly by the specimen. The hardness corresponds to a load to be applied to the end of the push pin. One degree (1°) is equivalent to 8 gf.

In addition, the squeegee 24 is inclined to come into contact with the inner circumferential surface 5*b* of the plate cylinder 5 at a suitable angle while the plate cylinder 5 is in rotation. The angle of inclination is determined depending upon factors such as a printing speed, the hardness of the squeegee, and the viscosity of ink. The rod-shaped member 25 is rotatably received in the plate cylinder 5 and is located substantially parallel to and in front of the squeegee 24 in the rotating direction of the plate cylinder 5.

The operation of the mimeographing printing machine will now be described.

The timing to bring the squeegee unit 23 into and out of contact with the plate cylinder 5 depends upon the cam 22 which is rotatable in response to the rotation of the plate cylinder 5. In other words, the squeegee unit 23 ascends and descends when it is pushed by the sector members 19, 19 which are pivotally moved in response to the angular movement of the cam 22.

As shown in FIG. 4(*a*), adjacent to the trailing end of the non-perforated portion 11, the squeegee unit 23 is brought into contact with the inner circumferential surface 5*b* of the plate cylinder 5. The squeegee unit 23 performs squeezing as shown in FIG. 4(*b*), and is moved upwardly immediately in front of the perforation-free portion 11 as shown in FIG. 4(*c*) so as to be brought out of contact with the inner circumferential surface 5*b* as shown in FIG 4(*d*).

At a suitable timing, ink is supplied onto an area of the inner circumferential surface 5*b* near the central portion of the squeegee unit 23 from the ink passage 15 through the supply hose 16.

Figure 5A:
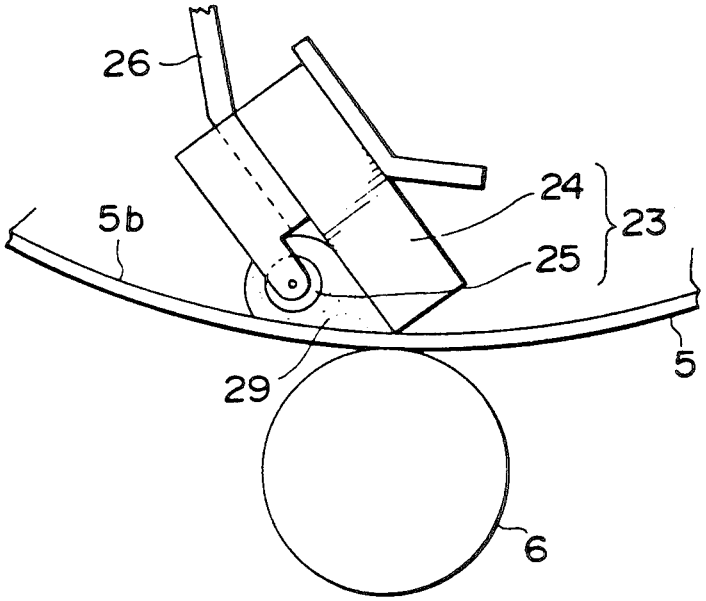
FIGS. 5(*a*) and 5(*b*) are views similar to FIGS. 4, also showing the upward and downward movements of the squeegee unit.
Figure 5B:
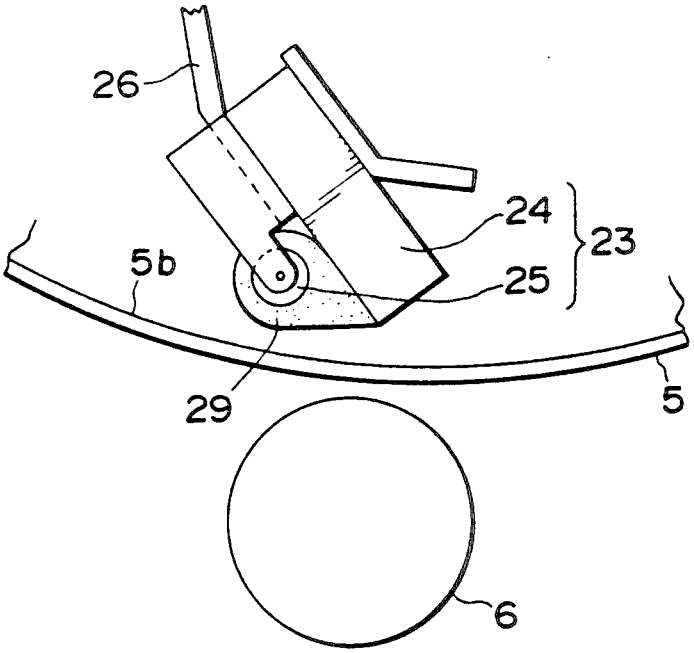
Figure 6:
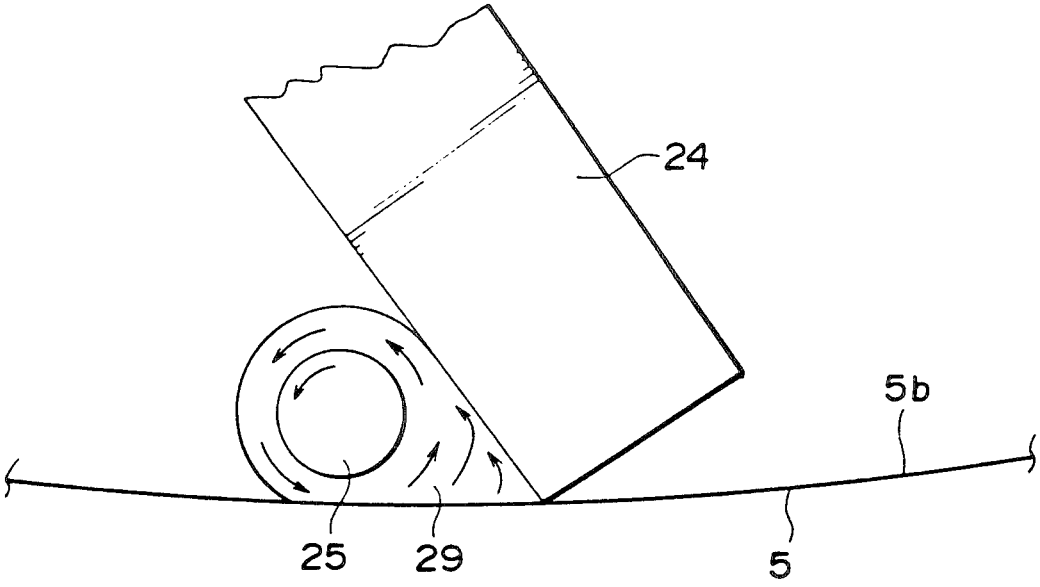
FIG. 6 shows the manner in which an ink reservoir is formed by the squeegee unit.

As shown in FIGS. 5 and 6, the supplied ink forms an ink reservoir 29 between the inner circumferential surface 5*b* of the plate cylinder 5 and the squeegee 24 in contact with the surface 5*b*. Under this condition, the rod-shaped member 25 sinks in the ink reservoir 29. The ink sticks around the rod-shaped member 25 in the ink reservoir 29. As shown in FIG. 6, the rod-shaped member 25 is rotated on its own axis by the ink whirling counterclockwise in response to the rotation of the plate cylinder 5. Therefore the ink reservoir 29 extends substantially uniformly along the squeegee 24.

When the printing image has a solid area, much of the ink in the ink reservoir 29 near the squeegee 24 is used firstly for the solid area. Next, when the squeegee 24 is moved in response to the rotation of the plate cylinder 5, unconsumed ink near the solid area is moved by the rotary rod-shaped member 25 so as to make up for a consumed ink. Since the rod-shaped member 25 effectively circulates the ink in the ink reservoir 29, the density of the ink can be maintained uniform even when there is a very little ink in the reservoir 29. Since the ink is always supplied at a proper amount, it does not overflow, so that the printed image always has an excellent quality.

Upon completion of the printing, the squeegee unit 23 including the squeegee 24 and the rod-shaped member 25 is moved upwardly. And the ink is jointly held by the squeegee 24 and the rod-shaped member 25, and is also moved upwardly from the plate cylinder 5 as shown in FIGS. 5(*a*) and 5(*b*).

Since the rotation of the rod-shaped member 25 in response to the whirling ink is continued by inertia even after the squeegee unit 23 ascends, the ink jointly held by both the squeegee and the rod-shaped member remains stuck around the rod-shaped member.

Therefore an appropriate amount of ink can be supplied only to the perforation 10 of the plate cylinder where the stencil is supported.

The ink is supplied again to the ink reservoir 29 from the ink passage 15 according to a detected amount of the ink in the ink reservoir 29. The amount of ink is detected by placing one of a pair of capacitor electrodes in the ink reservoir and by reviewing variations of capacity between the two capacitor electrodes, as proposed in a copending Japanese Patent Application No. 161,418/1981.

According to the foregoing embodiment, the mimeographic printing machine 1 can offer a uniform printing density and is free from the overflow of ink. In addition, since ink having a low viscosity can be used, the pressure of the press roller can be decreased. Further since the squeegee 24 is tilted with 40° out of the perpendicular so as to come into contact with the inner circumferential surface 5*b* of the plate cylinder 5, noises can be reduced and a sufficient printing density can be obtained even when the plate cylinder 5 is rotated at a high speed.

A second embodiment of the invention will be described with reference to FIGS. 7 and 8. The means and members similar to those of the first embodiment will be designated by the same reference numerals and will not be described in detail.

Figure 7A:
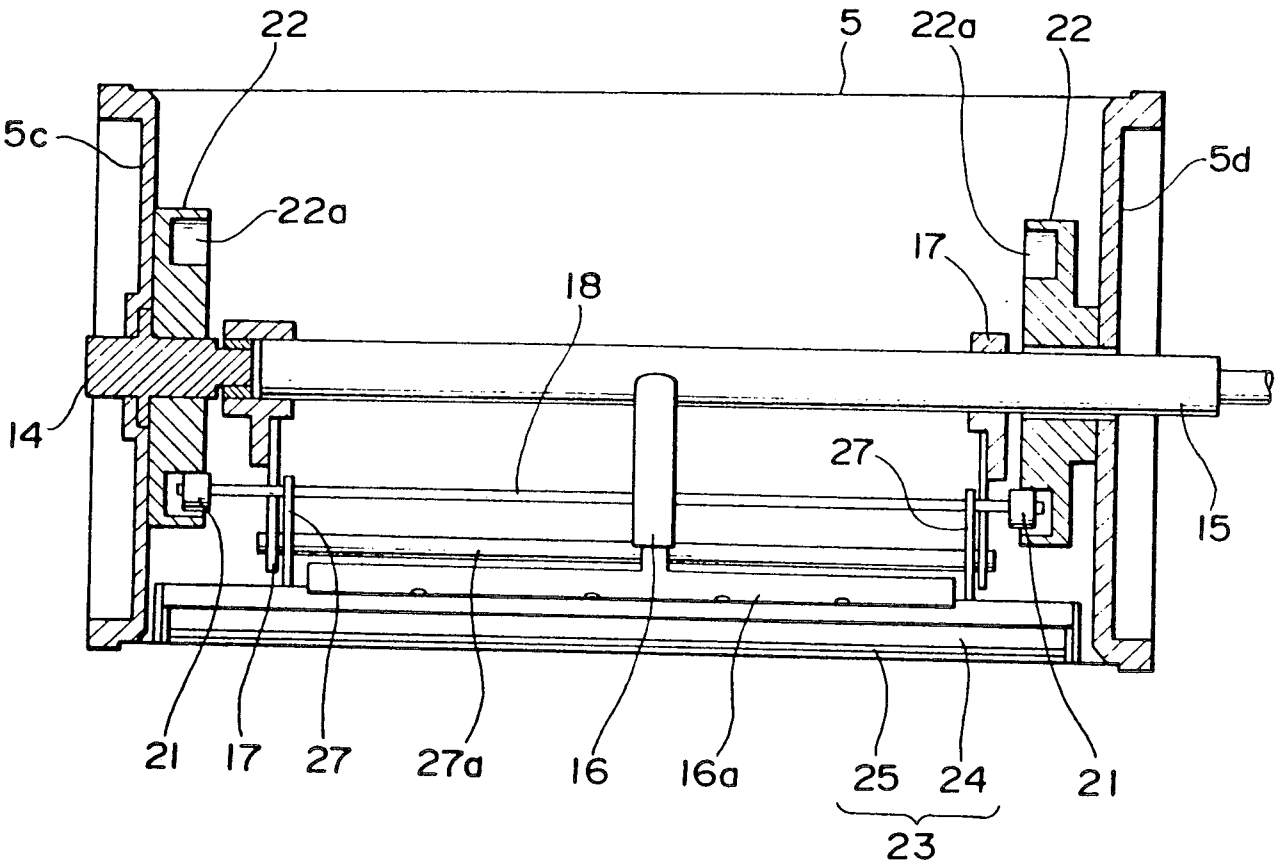
FIG. 7(*a*) is a longitudinal cross-sectional view of a plate cylinder according to a second embodiment, showing a squeegee unit contacting the plate cylinder.
Figure 7B:
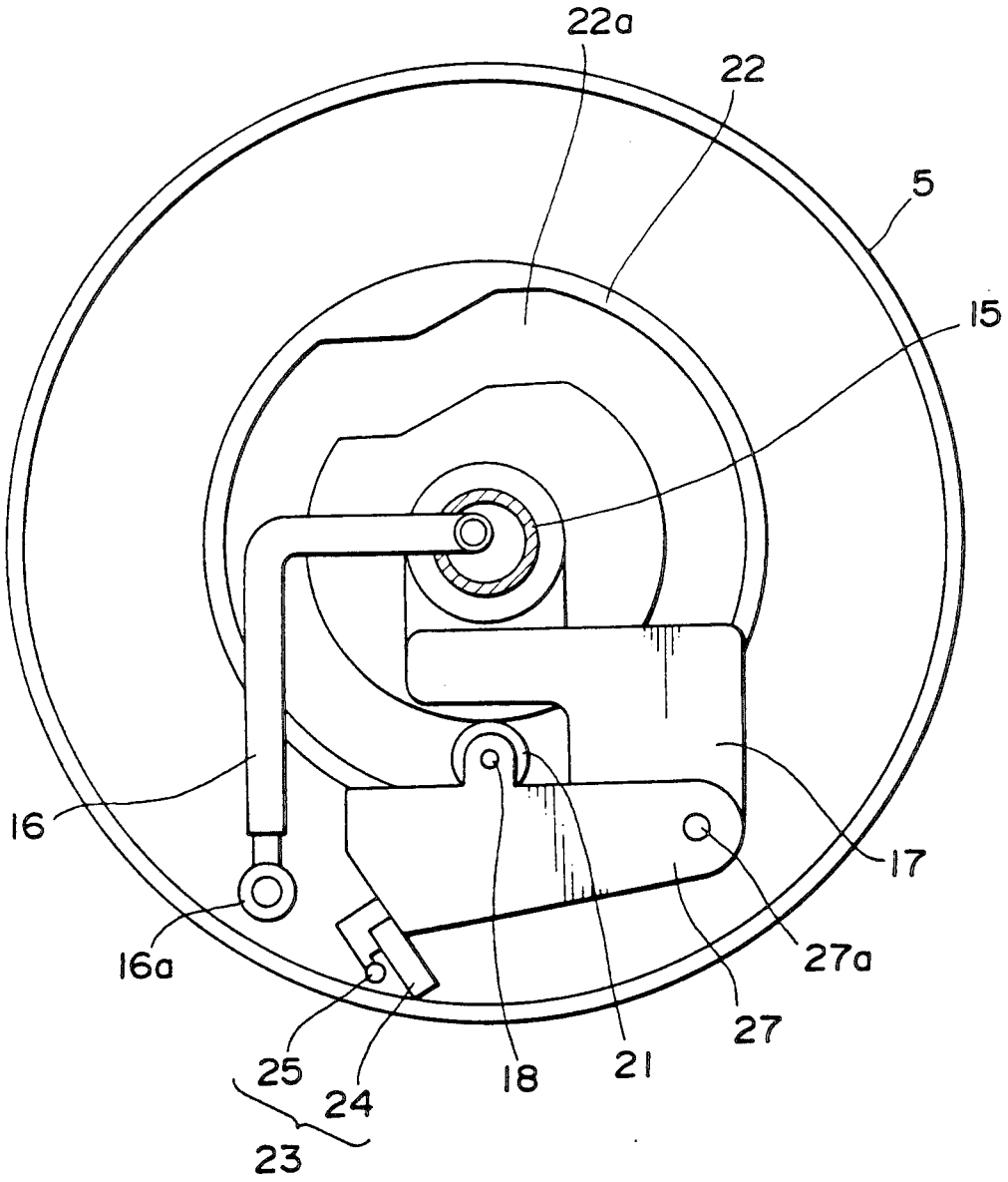

In this embodiment, a plate cylinder 5 includes a support shaft 14 fixedly mounted on one end 5c thereof, and has a central hole in the other end 5d thereof, as shown in FIG. 7(*a*). The support shaft 14 is rotatable with the plate cylinder 5. A tubular ink passage 15 is inserted through the central hole on end 5d of the plate cylinder 5. One end of the ink passage 15 is rotatably received in an inner end of the support shaft 14. The support shaft 14 and the other end of the ink passage 15 are supported on a non-illustrated support means.

A supply hose 16 extends from the central portion of the ink passage 15, and the end of the ink supply hose is connected to a distributor 16a. The distributor 16a is somewhat shorter than a squeegee 24, and has open ends and a perforation formed longitudinally on a side thereof.

A pair of immovable plates 17, 17 extends downwardly from the ink passage 15 and is not movable regardless of the rotation of the plate cylinder 5. A pivot 27a is disposed between the immovable plates 17, 17 at their one ends. A pair of squeegee unit support arms 27 for supporting a squeegee unit 23 are pivotally supported on opposite ends of the pivot 27a. The squeegee unit 23 similar to that in the first embodiment is supported by opposite ends of the unit support arm 27 as shown in FIG. 7(*b*).

A shaft 18 is located between the support arms 27, 27 at their central portions, and rotatably receives a pair of cam followers 21, 21 at opposite ends thereof. The cam followers 21 rest on a pair of cams 22, 22 fixedly received in opposite ends 5c, 5d of the plate cylinder 5. Each of the cams 22, 22 is in the shape of a disk. On the circumferential surfaces, the cams 22, 22 have grooves 22a, 22a slightly wider than the diameter of the cam followers 21, 21 so that the cam followers 21 angularly move on the cam grooves 22a, 22a.

Figure 8A:
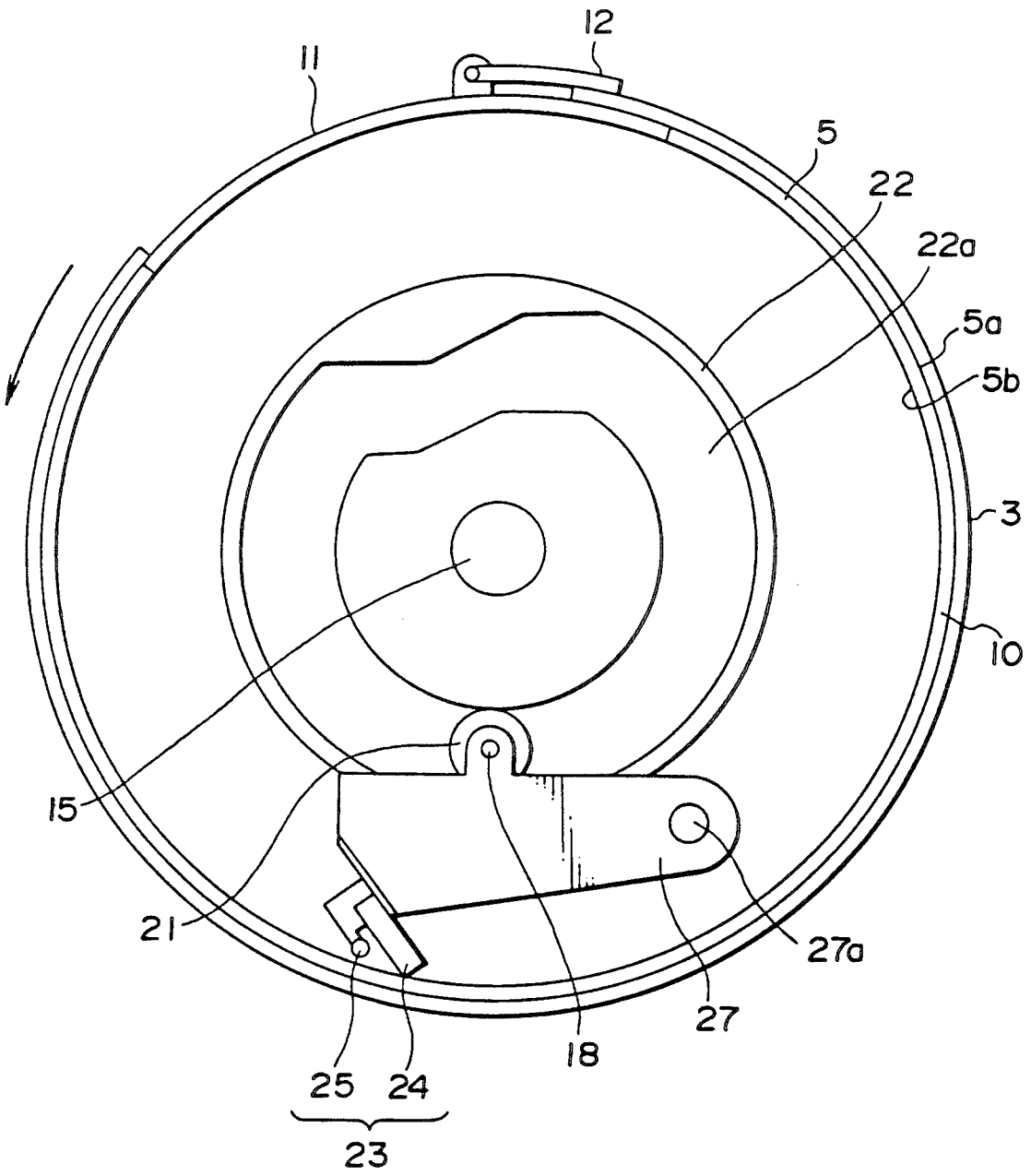
FIGS. 8(*a*) and 8(*b*) show the upward and downward movements of the squeegee unit according to the embodiment of FIGS. 7.
Figure 8B:
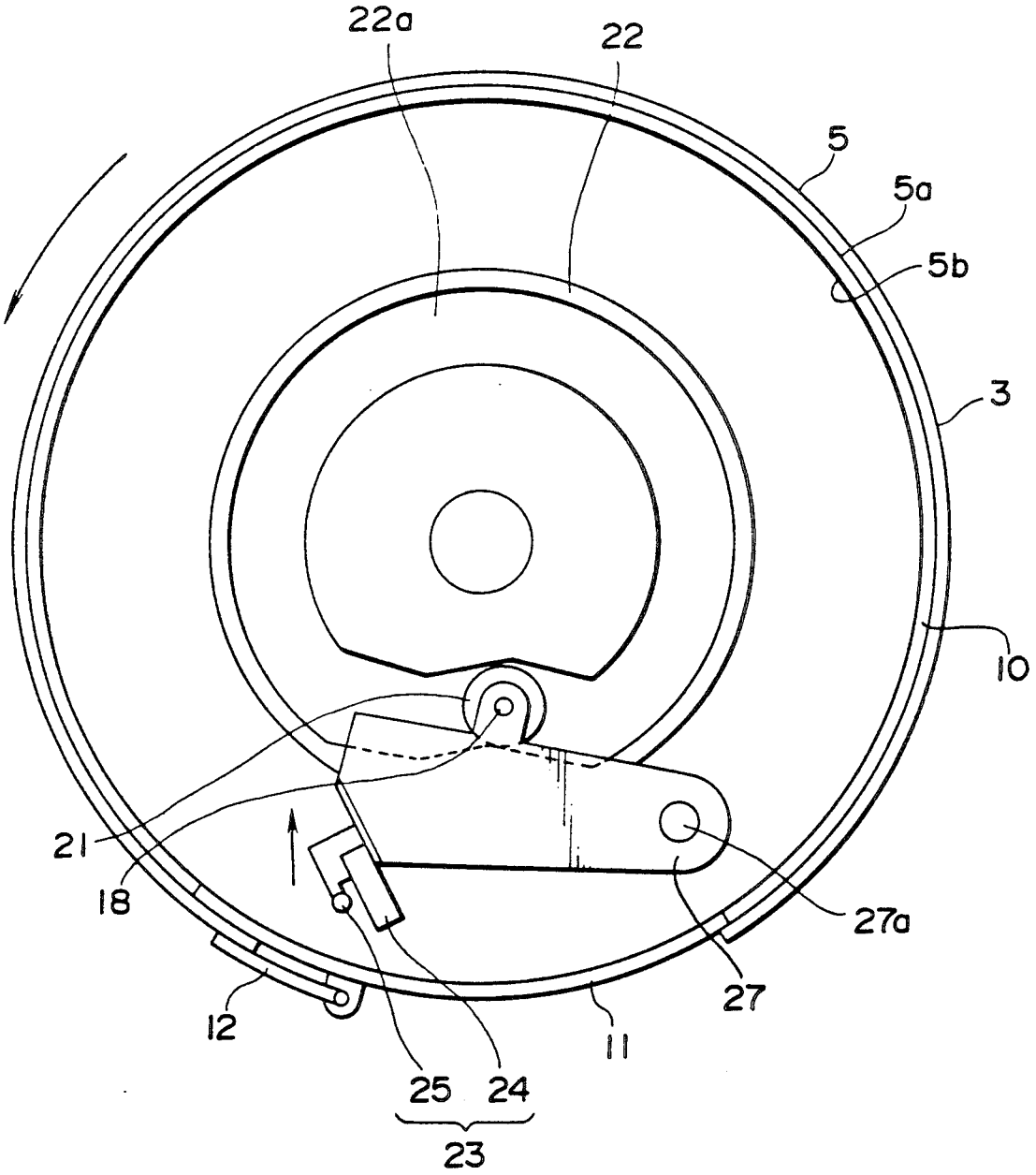

As shown in FIGS. 8(*a*) and 8(*b*), when the plate cylinder 5 is in rotation, the support arm 27 is pivotally moved at a timing determined according to the shape of the grooves 22a, 22a of the cams 22, 22 in such a manner that the squeegee unit 23 is moved upwardly and downwardly.

According to the second embodiment, the mimeographic printing machine 1 can offer the advantageous results similar to those in the first embodiment. In addition, since the upward and downward movements of the squeegee unit 23 can be carried out only by the cams 22, 22 and cam followers 21, 21, the configuration of the squeegee unit can be simplified. Neither fine adjustment nor consideration for durability of resilient members such as the springs 28 is necessary since there is no resilient members. In addition, smooth movement of the squeegee unit 23 prevents noises. The distributor 16a distributes the ink to portions on the inner circumferential surface 5b of the plate cylinder 5 in such a manner that the ink can be quickly spread over the surface 5b.

Although a pair of the cams 22, 22 are disposed at opposite ends 5c, 5d of the plate cylinder 5, either one of the cams 22, 22 will serve for the foregoing purpose.

In the foregoing embodiments, the rod-shaped member 25 is designed so as to be rotatable in response to the whirling ink. The rod-shaped member 25 may be forcibly rotated by a suitable driving means. In such a case, the ink reservoir 29 can be uniformly spread over the inner circumferential surface of the plate cylinder in a shorter period of time. Therefore the rotation of the rod-shaped member will not be prevented by a solidified ink. When it is forcibly rotated, the rod-shaped member keeps on rotating without decreasing its speed even after the squeegee is moved upwardly, so that the rod-shaped member can hold the ink more reliably. Even when the printing machine is restarted after a long idling time, the rod-shaped member accelerates formation of ink whirls to obtain a viscosity of the ink suitable for the printing.

Although the rod-shaped members 25 in the foregoing embodiments are round bars, their shapes, materials and size can be easily changed in such a manner that the rod-shaped members can be easily received in the ink reservoir 29. A variety of rod-shaped members were proposed in a copending Japanese Patent Application No. 113,850/1983.

Figure 10:
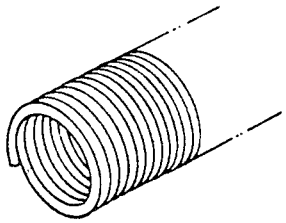
FIGS. 10 to 13 show modifications of rod-shaped members in the respective embodiments of the invention.
Figure 11:
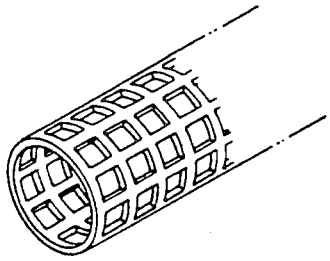
Figure 12:
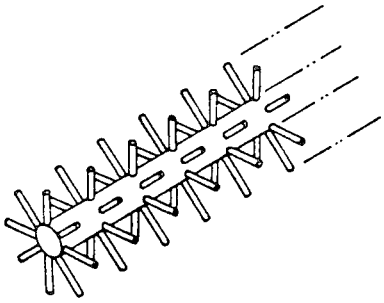
Figure 13:
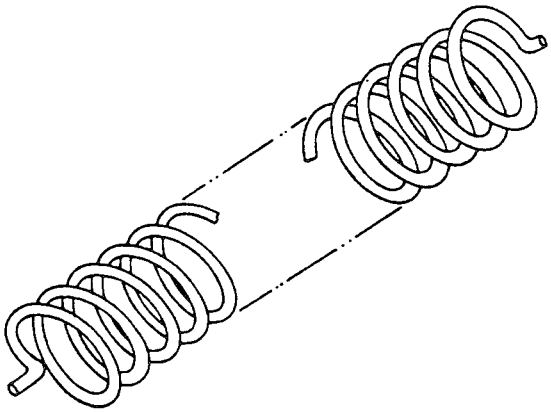
Figure 14:
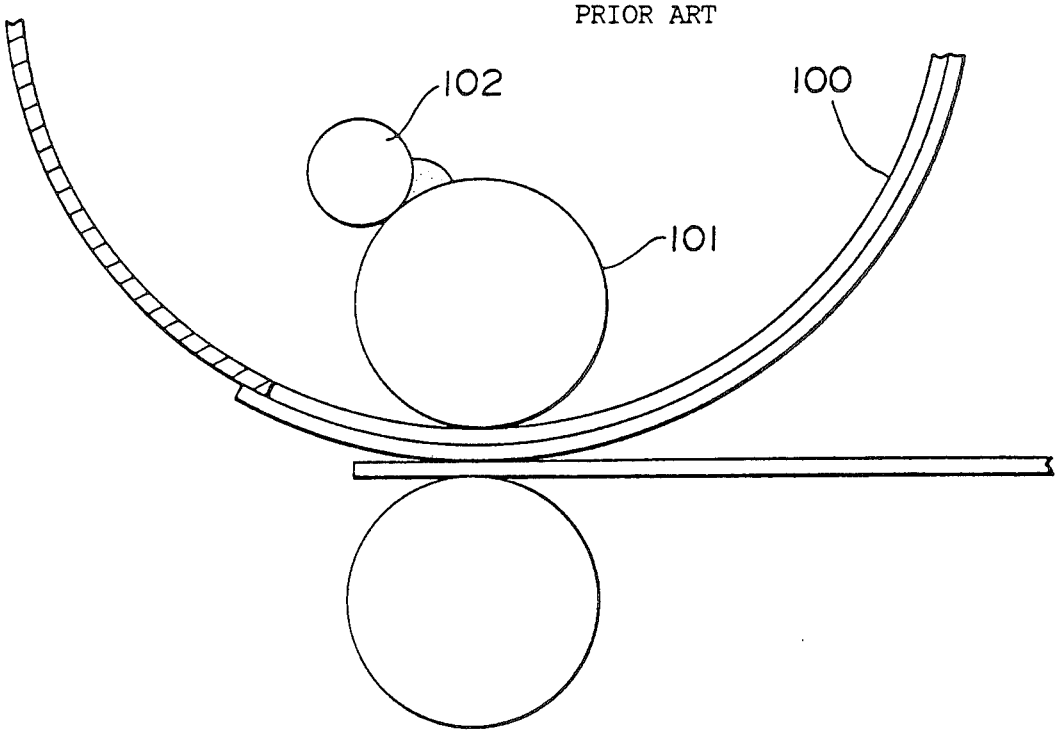
FIG. 14 PRIOR ART
FIG. 14 is a schematic view showing a typical prior art ink supplying mechanism.
Figure 15:
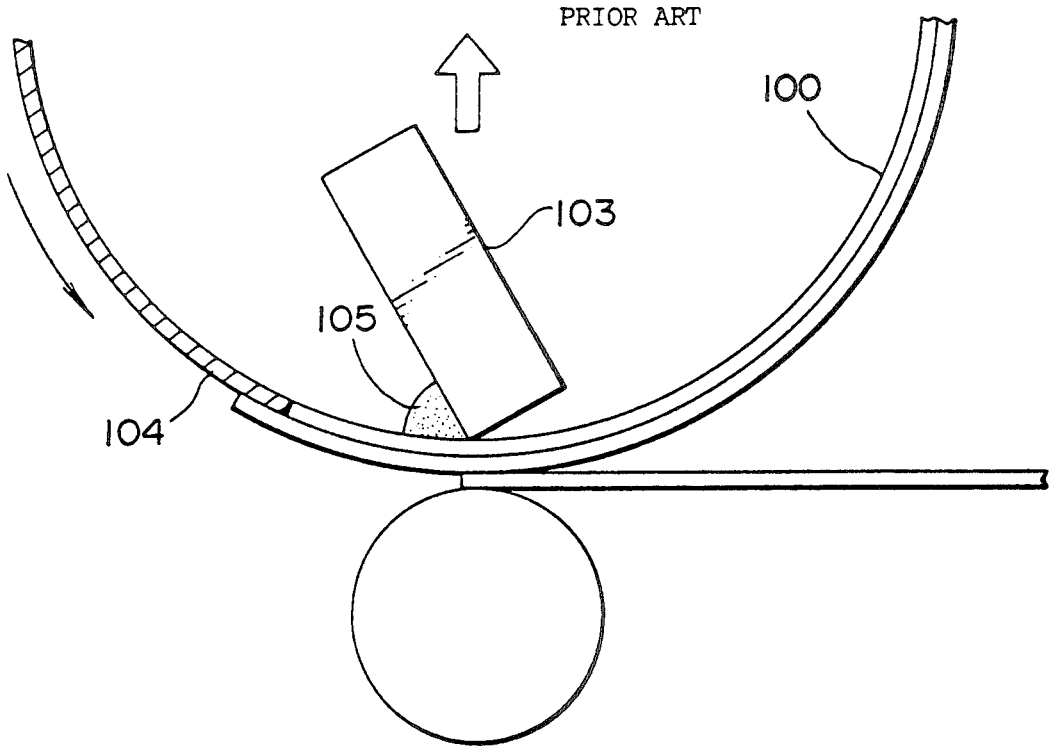
FIG. 15 PRIOR ART
FIG. 15 is a transverse cross-sectional view of a typical prior art mimeographing printing machine having a squeegee.
Figure 16A:
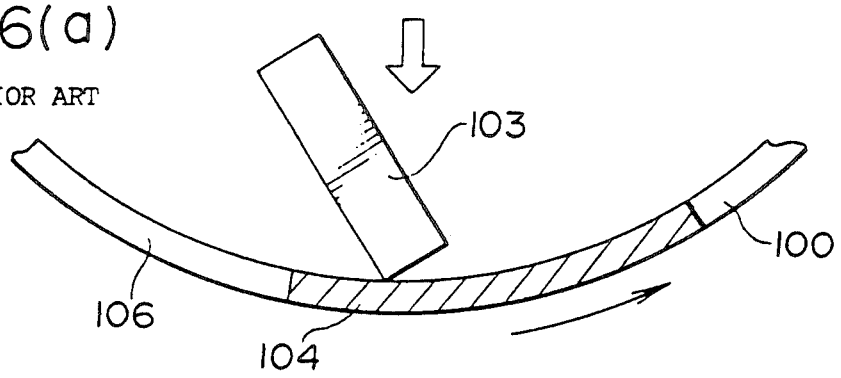
FIG. 16(a) PRIOR ART
FIGS. 16(*a*) to 16(*d*) are views exemplifying problems encountered in the printing machine of FIG. 15.
Figure 16B:
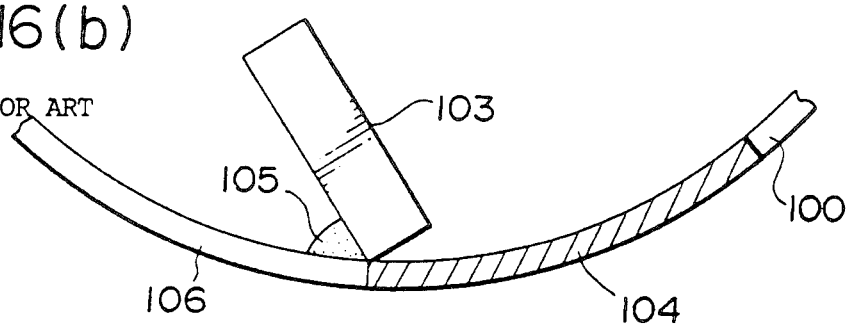
FIG. 16(b) PRIOR ART
Figure 16C:
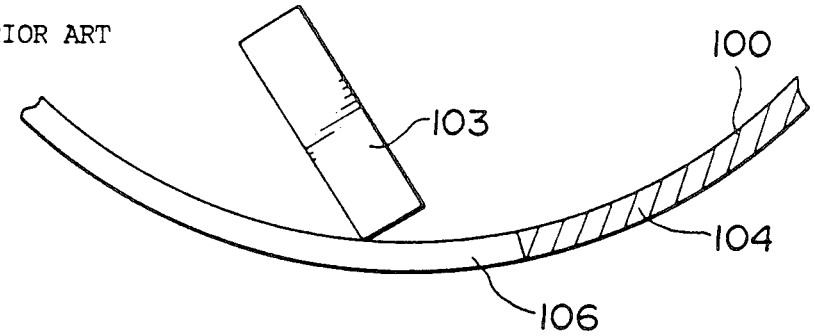
FIG. 16(c) PRIOR ART
Figure 16D:
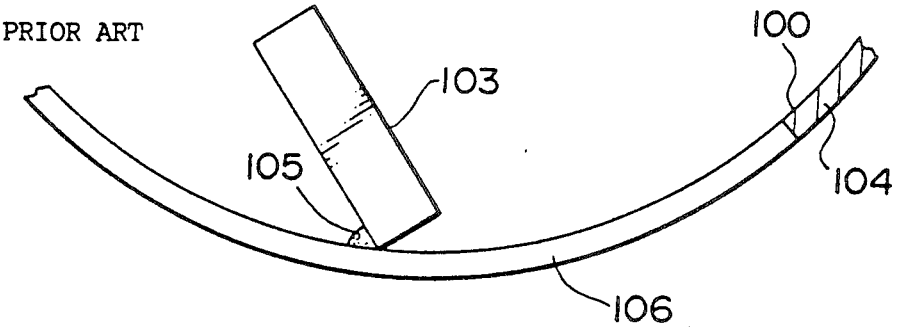
FIG. 16(d) PRIOR ART

The rod-shaped member may be a compression coil spring as shown in FIG. 10, a cylindrical member having a plurality of holes on an outer circumferential surface thereof as in FIG. 11, a relatively thin round bar having a plurality of pins extending from an outer circumferential surface thereof as shown in FIG. 12, or a pair of opposite spirals connected at one ends thereof as shown in FIG. 13.

Figure 9:
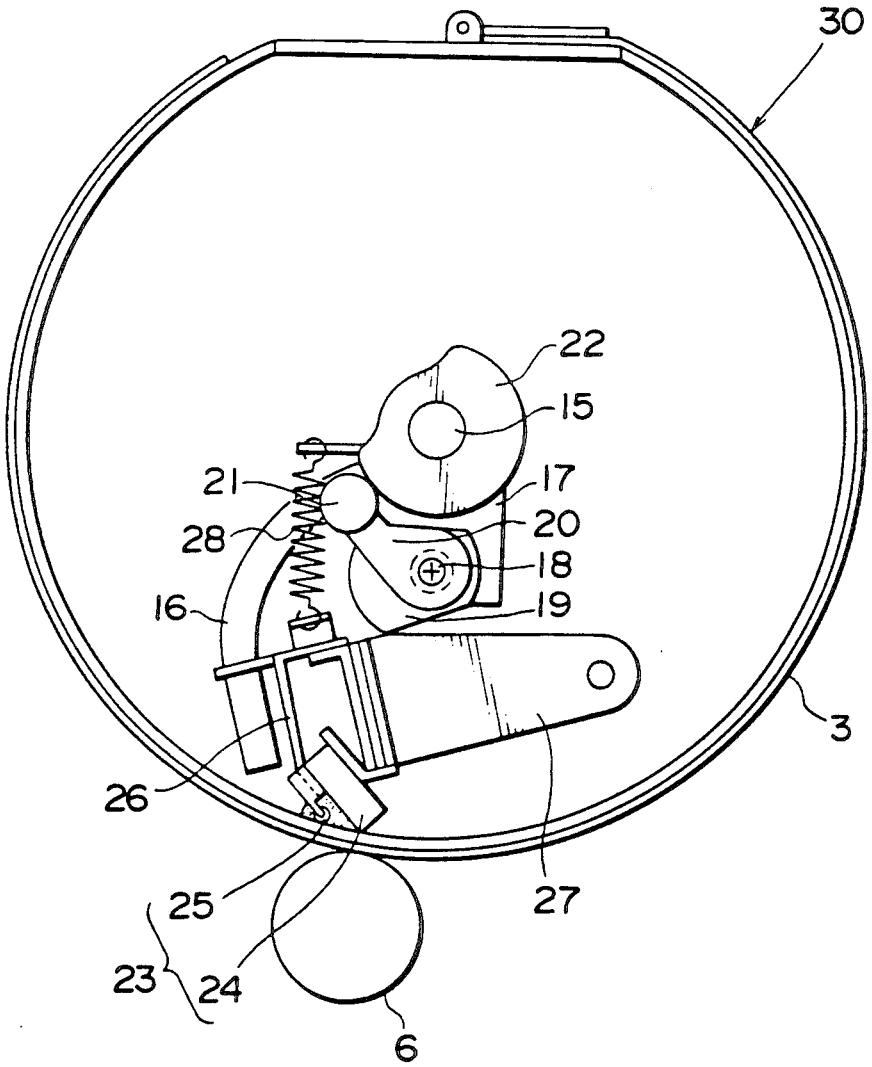
FIG. 9 is a transverse cross-sectional view of a plate cylinder according to a third embodiment.

The plate cylinders 5 are of a open-end type in each of the foregoing embodiments. In such plate cylinders, the squeegee unit 23 which moves into and out of contact with the inner circumferential surface of the plate cylinder is very effective, but it is also effective for the plate cylinder having any truncated portion or seams as in a plate cylinder 30 (FIG. 9) of D-shaped cross section.

The plate cylinder 5 is a single-layer metallic cylinder. The present invention is also applicable to a printing machine, which comprises a double-layer plate cylinder including one metallic cylinder and one screen layer, or a three-layered plate cylinder including one metallic cylinder and two screen layers.

According to the invention, the rod-shaped member is rotatably received in the plate cylinder and is closely located behind the squeegee in the rotating direction of the plate cylinder. Both the rod-shaped member and the squeegee are brought into and out of contact with the inner circumferential surface of the plate cylinder in such a manner that they jointly hold the ink reservoir. Therefore the density of the ink can be always maintained constant regardless of the upward and downward movement of the squeegee.

What is claimed is:

1. A mimeographic printing machine comprising:

a rotary plate cylinder with an inner circumferential surface and an outer circumferential surface adapted to support a stencil thereon, said plate cylinder having a perforation adapted to pass ink therethrough, a non-perforation portion for preventing passage of ink and, a clamping portion formed on the non-perforation portion for holding an edge of the stencil, said plate cylinder being rotatable with the stencil supported thereon;

means for supplying the ink to the inner circumferential of said plate a squeegee movably received in said plate cylinder, said squeegee contacting the inner circumferential of said plate cylinder for a predetermined length starting from an edge of the non-perforation portion before the perforation and ending at the perforation immediately before the non-perforation portion, said squeegee being operable for squeezing the ink from said supplying means toward the outer circumferential surface of said plate cylinder through said perforation of said plate cylinder; and a rod shaped member rotatably received in said plate cylinder, means to fix said rod shaped member relative to said squeegee and in front of said squeegee in the rotating direction of said plate cylinder at a predetermined distance away from the squeegee, said means to fix allowing said rod shaped member and said squeegee to be movable together with respect to the plate cylinder, said means to fix further locating said rod shaped member substantially parallel to both said squeegee and the surface of said plate cylinder and at a predetermined distance away from the inner circumferential surface of the plate cylinder when the squeegee contacts the inner circumferential surface so that the rod shaped member distributes the ink to the squeegee smoothly and effectively throughout the entire length of the squeegee.

2. A mimeographic printing machine according to claim 1, further comprising:

a cam movable in response to the rotation of said plate cylinder; and means for bringing said squeegee into contact with the inner circumferential surface of said plate cylinder at the predetermined length in response to the movement of said cam.

3. A mimeographic printing machine according to claim 1, further comprising:

a resilient member normally urging said squeegee and said rod-shaped member away from the inner circumferential surface of said plate cylinder;

a cam movable in response to the rotation of said plate cylinder; and means for moving said squeegee and said rod-shaped member in response to angular movement of said cam and also for bringing said squeegee into contact with the inner circumferential surface of said plate cylinder at the predetermined length.

4. A mimeographic printing machine according to claim 1, further comprising:

an arm supporting thereon said squeegee and said rod-shaped member and pivotally movable in said plate cylinder;

a cam movable in response to the rotation of said plate cylinder; and a cam follower supported on said arm and resting on said cam;

whereby said squeegee is brought into contact with the inner circumferential surface of said plate cylinder by pivotal movement of said arm at the predetermined length in response to the rotation of both said plate cylinder and said cam.

5. A mimeographic printing machine according to claim 1, wherein said supplying means includes a distributor for distributing the ink axially along said plate cylinder.

6. A mimeographic printing machine according to claim 5, wherein said distributor extends parallel to the squeegee and is located in front of the rod-shaped member in the rotating direction of the plate cylinder, said distributor having openings for quickly supplying the ink to the squeegee and the rod-shaped member.

7. A mimeographic printing machine according to claim 5, wherein said plate cylinder includes opposite end portions, at least one of the opposite end portions having a cam with a cam groove, said printing machine further including a shaft with a cam follower, said cam follower engaging the cam groove and the shaft being connected to the squeegee and the rod-shaped member so that the squeegee and the rod-shaped member are moved relative to the inner circumferential surface by the cam and the cam follower.

8. A mimeographic printing machine according to claim 1, further comprising a drive means for angularly moving said rod-shaped member in such a manner that the ink held by said squeegee and said rod-shaped member is dispersed longitudinally of said squeegee.

9. A mimeographic printing machine according to claim 1, wherein the ink is retained between the rod-shaped member and the squeegee when printing, the rod-shaped member being rotated by the ink flowing substantially between the rod-shaped member and the squeegee and blocked by the squeegee so that the ink can be smoothly supplied to a consumed area between the rod-shaped member and the squeegee.

* * * * *